US007034682B2

(12) United States Patent
Beggs et al.

(10) Patent No.: US 7,034,682 B2
(45) Date of Patent: Apr. 25, 2006

(54) DOOR WITH A SAFETY ANTENNA

(75) Inventors: Ryan P. Beggs, Dubuque, IA (US); Lucas I. Paruch, Dubuque, IA (US); James C. Boerger, Franksville, WI (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 465 days.

(21) Appl. No.: 10/600,253

(22) Filed: Jun. 20, 2003

(65) Prior Publication Data

US 2005/0044792 A1 Mar. 3, 2005

(51) Int. Cl.
*G08B 13/08* (2006.01)
*E05F 15/20* (2006.01)
*E05F 15/02* (2006.01)

(52) U.S. Cl. ..... 340/545.1; 340/545.2; 340/545.3; 340/545.7; 340/551; 49/25; 49/26; 49/27; 49/28; 160/1; 160/310

(58) Field of Classification Search ..... 340/545.1, 340/545.2, 545.3, 545.7, 551; 49/25–28; 160/1, 310
See application file for complete search history.

(56) References Cited

U.S. PATENT DOCUMENTS

| | | | |
|---|---|---|---|
| 3,303,303 | A | 2/1967 | Miller |
| 3,346,856 | A | 10/1967 | Doble |
| 3,352,059 | A | 11/1967 | Metz |
| 3,670,164 | A | 6/1972 | Hardy et al. |
| 3,855,733 | A | 12/1974 | Miller |
| 3,989,932 | A | 11/1976 | Koerner |
| 4,051,336 | A | 9/1977 | Miller |
| 4,075,563 | A | 2/1978 | Battle |
| 4,103,252 | A | 7/1978 | Bobick |
| 4,143,367 | A | 3/1979 | Scheslag |
| 4,169,260 | A | 9/1979 | Bayer |
| 4,240,528 | A | 12/1980 | Kraus |
| 4,342,354 | A | 8/1982 | Leivenzon et al. |
| 4,345,167 | A | 8/1982 | Calvin |
| 4,501,963 | A | 2/1985 | Perisic |

(Continued)

FOREIGN PATENT DOCUMENTS

| | | |
|---|---|---|
| CA | 2049112 | 5/2002 |

(Continued)

OTHER PUBLICATIONS

Smart Gate, Inc; *Non-contact Safety for Gates and Doors*, circa Jan. 1, 2005, 10 Pages.

(Continued)

*Primary Examiner*—Jeffery Hofsass
*Assistant Examiner*—Lam Pham
(74) *Attorney, Agent, or Firm*—Hanley, Flight, & Zimmerman, LLC

(57) ABSTRACT

A door system includes an antenna-based proximity sensor with a releasable electrical connector that enables the sensor to function with a breakaway feature of the door. The sensor includes a signal generator and a door-mounted antenna for sensing a body or an obstruction near the door. The signal generator (or oscillator) can be installed at various locations between a power source and the antenna. In some cases, the wiring between the antenna and the power source includes a rotatable feature to accommodate the rotation of a drum that carries a wrap-up, pliable door panel. The rotatable feature may be a rotatable electrical connector, or it may be a wire having sufficient length and flexibility to twist about itself within the hollow interior of the drum.

21 Claims, 11 Drawing Sheets

U.S. PATENT DOCUMENTS

| | | | |
|---|---|---|---|
| 4,519,474 | A | 5/1985 | Iseli et al. |
| 4,551,711 | A | 11/1985 | Klyama et al. |
| 4,565,029 | A | 1/1986 | Kornbrekke et al. |
| 4,611,197 | A | 9/1986 | Sansky |
| 4,612,442 | A | 9/1986 | Toshimichi |
| 4,623,032 | A | 11/1986 | Kemmer |
| 4,652,864 | A | 3/1987 | Calvin |
| 4,706,227 | A | 11/1987 | DuVall et al. |
| RE032,828 | E | 1/1989 | Mudge |
| 4,833,450 | A | 5/1989 | Buccola |
| 4,849,635 | A | 7/1989 | Sugimoto |
| 4,849,735 | A | 7/1989 | Kirtley et al. |
| 4,853,531 | A | 8/1989 | Rege |
| 4,857,912 | A | 8/1989 | Everett, Jr. et al. |
| 4,944,116 | A | 7/1990 | Mewald |
| 4,967,083 | A | 10/1990 | Kornbrekke et al. |
| 5,001,557 | A | 3/1991 | Regli |
| 5,026,990 | A | 6/1991 | Marman et al. |
| 5,027,552 | A | 7/1991 | Miller et al. |
| 5,034,722 | A | 7/1991 | Premack |
| 5,055,685 | A | 10/1991 | Sugimoto et al. |
| RE033,824 | E | 2/1992 | Johnson |
| 5,142,152 | A | 8/1992 | Boluncaner |
| 5,142,822 | A | 9/1992 | Beckerman |
| 5,149,921 | A | 9/1992 | Picado |
| 5,198,974 | A | 3/1993 | Orsat |
| 5,216,246 | A | 6/1993 | Weldman et al. |
| 5,216,410 | A | 6/1993 | Pildner et al. |
| 5,228,492 | A | 7/1993 | Jou |
| 5,229,617 | A | 7/1993 | Saitoh et al. |
| 5,314,037 | A | 5/1994 | Shaw et al. |
| RE034,665 | E | 7/1994 | Strand |
| 5,334,972 | A | 8/1994 | Sugimoto et al. |
| 5,335,749 | A | 8/1994 | Taguchi et al. |
| 5,337,039 | A | 8/1994 | Simon |
| 5,357,183 | A | 10/1994 | Lin |
| 5,384,982 | A | 1/1995 | Galperin |
| 5,410,149 | A | 4/1995 | Winston, Jr. et al. |
| 5,420,430 | A | 5/1995 | Trett |
| 5,461,231 | A | 10/1995 | Sugimoto et al. |
| 5,468,960 | A | 11/1995 | Sugimoto et al. |
| 5,489,892 | A | 2/1996 | Imuro et al. |
| 5,541,585 | A | 7/1996 | Duhame et al. |
| 5,584,145 | A | 12/1996 | Teich |
| 5,592,777 | A | 1/1997 | Petri et al. |
| 5,596,840 | A | 1/1997 | Teich |
| 5,644,111 | A | 7/1997 | Cerny et al. |
| 5,652,577 | A | 7/1997 | Frasier |
| 5,656,995 | A | 8/1997 | Peters |
| 5,689,235 | A | 11/1997 | Sugimoto et al. |
| 5,703,368 | A | 12/1997 | Tomooka et al. |
| 5,706,875 | A | 1/1998 | Simon |
| 5,712,477 | A | 1/1998 | Delaney, III et al. |
| 5,713,621 | A | 2/1998 | Krenkel et al. |
| 5,728,984 | A | 3/1998 | Miller |
| 5,739,523 | A | 4/1998 | Tsutsumi et al. |
| 5,743,317 | A | 4/1998 | Beringer et al. |
| 5,789,739 | A | 8/1998 | Schwarz |
| 5,793,357 | A | 8/1998 | Ivey et al. |
| 5,812,058 | A | 9/1998 | Sugimoto et al. |
| 5,828,302 | A | 10/1998 | Tsutsumi et al. |
| 5,832,665 | A | 11/1998 | Miller et al. |
| 5,839,227 | A | 11/1998 | Gardner |
| 5,921,026 | A | 7/1999 | Miller |
| 5,957,187 | A | 9/1999 | Gruben et al. |
| 5,964,058 | A | 10/1999 | Richardson |
| 5,986,265 | A | 11/1999 | Kim et al. |
| 5,996,281 | A | 12/1999 | Takano et al. |
| 6,002,333 | A | 12/1999 | Hickey |
| 6,080,981 | A | 6/2000 | Payne |
| 6,172,315 | B1 | 1/2001 | Miller et al. |
| 6,218,940 | B1 | 4/2001 | Reje et al. |
| 6,243,006 | B1 | 6/2001 | Reje et al. |
| 6,265,970 | B1 | 7/2001 | Whitehead |
| 6,286,257 | B1 | 9/2001 | Gregoriou et al. |
| 6,326,899 | B1 | 12/2001 | Chisnall |
| 6,342,706 | B1 | 1/2002 | Takeda |
| 6,347,486 | B1 * | 2/2002 | Badillet ..... 49/394 |
| 6,348,685 | B1 | 2/2002 | Givet |
| 6,348,863 | B1 | 2/2002 | Krubner et al. |
| 6,414,314 | B1 | 7/2002 | Ikeda |
| 6,427,382 | B1 | 8/2002 | Gregoriou et al. |
| 6,502,619 | B1 | 1/2003 | Krauetler |
| 6,571,512 | B1 | 6/2003 | Miller et al. |
| 6,598,648 | B1 * | 7/2003 | Schulte ..... 160/1 |
| 6,600,113 | B1 | 7/2003 | Miller |
| 6,612,357 | B1 | 9/2003 | Beringer et al. |
| 6,651,385 | B1 | 11/2003 | Miller et al. |
| 6,678,999 | B1 | 1/2004 | Zengguang et al. |
| 6,683,296 | B1 | 1/2004 | Miller et al. |
| 6,730,902 | B1 | 5/2004 | Imai et al. |
| 6,750,441 | B1 | 6/2004 | Imahori et al. |
| 6,779,302 | B1 | 8/2004 | Harrison et al. |
| 6,860,065 | B1 * | 3/2005 | Griffin et al. ..... 49/139 |
| 2002/0041231 | A1 | 4/2002 | Drinkard |
| 2002/0046494 | A1 | 4/2002 | Miller et al. |
| 2003/0047670 | A1 | 3/2003 | Miller et al. |
| 2003/0192252 | A1 | 10/2003 | Harrison et al. |
| 2004/0088922 | A1 | 5/2004 | Miller et al. |
| 2004/0187406 | A1 | 9/2004 | Gallagher et al. |
| 2004/0194386 | A1 | 10/2004 | Albiero |

FOREIGN PATENT DOCUMENTS

| | | |
|---|---|---|
| DE | 3031363 | 12/1981 |
| DE | 297 14 616 U1 | 11/1997 |
| DE | 29714616 | 1/1998 |
| DE | 199 28 211 A | 12/2000 |
| DE | 19928211 | 12/2000 |
| DE | 10203145 | 4/2003 |
| EP | 0236755 | 9/1987 |
| EP | 0624857 | 5/1994 |
| EP | 0699619 | 7/1995 |
| EP | 0671532 | 9/1995 |
| EP | 0678649 | 10/1995 |
| EP | 0765990 | 9/1996 |
| EP | 0902158 A2 | 3/1999 |
| EP | 0902158 B1 | 3/1999 |
| EP | 0914536 | 5/1999 |
| EP | 1233138 | 8/2002 |
| EP | 1253276 | 10/2002 |
| EP | 0843070 | 3/2003 |
| EP | 0902157 A2 | 3/2003 |
| EP | 0902157 B1 | 6/2003 |
| GB | 1578493 | 3/1978 |
| GB | 1 578 493 | 11/1980 |
| GB | 2343710 | 3/1999 |
| GB | 2354068 | 8/2000 |
| GB | 2391936 | 8/2002 |
| JP | 05001991 | 1/1993 |
| JP | 07038622 | 9/1995 |
| JP | 2002138781 | 11/2000 |
| JP | 2001147276 | 5/2001 |
| JP | 20011317270 | 11/2001 |
| JP | 2002106277 | 4/2002 |
| JP | 2002121983 | 4/2002 |
| JP | 2002285755 | 10/2002 |
| JP | 2003265639 | 9/2003 |
| JP | 2004068515 | 3/2004 |
| WO | 1998003757 | 1/1998 |
| WO | 2000053880 | 9/2000 |
| WO | 2002019698 | 3/2002 |
| WO | 2002029747 | 4/2002 |
| WO | 2002029748 | 4/2002 |

| | | |
|---|---|---|
| WO | 2003027424 | 4/2003 |
| WO | 2003087513 | 4/2003 |
| WO | 2003085230 | 10/2003 |
| WO | 2003100941 | 12/2003 |

OTHER PUBLICATIONS

Overhead Door Corporation, *Jetroll, Overhead Door JETROLL, Form A-988*, Oct. 1995, 14 Pages.

Optex, Inc.; Product Brochure for VX-40/40A Multi Stablized Outdoor Detector; Received by applicant prior to Oct. 17, 2002, 4 Pages.

International Search Report from PCT/US04/019224 dated Nov. 17, 2004.

* cited by examiner

DOOR WITH A SAFETY ANTENNA

BACKGROUND OF THE INVENTION

1. Field of the Invention

The subject invention generally pertains to a system for detecting the presence of a body near a door and more specifically to a system that includes an antenna for sensing the body.

2. Description of Related Art

There are a wide variety of available devices for detecting the presence of a body, such as a person or object, near a doorway. Such detection devices, known as proximity sensors, photoelectric eyes, motion detectors, etc., operate under various principles including, ultrasonics; active and passive detection of infrared radiation; detection of electromagnetic radiation (including sensing radio waves or sensing changes in capacitance or impedance); detecting a Doppler shift in microwaves; and lasers. In response to sensing a nearby body, the detector may simply trigger a light or an alarm, or the device may affect the operation of a door.

Some proximity sensors comprise an antenna that creates an electromagnetic field along the leading edge of a vertically operating door. When a nearby body disturbs the field, the sensor may trigger a controller to stop or reverse the closing action of the door. If the antenna moves vertically with the door and the controller and power supply are stationary, then wiring between the antenna and the controller must allow for the movement of the antenna. This can be accomplished by using a flexible coiled cable between the controller and the antenna. A coiled cable, however, has its limitations.

Many doors, for instance, have a breakaway feature that allows a door to temporarily break away from its vertical guide tracks should a collision occur between the door and a vehicle or other obstruction. During the collision, the breakaway feature allows the door to yield without permanently damaging the door or its guide tracks. After the collision, the door is readily restored to its normal operation. Although a coiled cable may have sufficient flexibility to allow a door to open and close, such a cable may get entangled with the door, track or vehicle during a collision.

Thus, a need exists for a way to use an antenna-based proximity sensor on a door that has a breakaway feature.

SUMMARY OF THE INVENTION

In some embodiments, a vertically translating door with a breakaway feature includes an antenna disposed along a leading edge of the door. A releasable electrical connector between the antenna and a stationary power source allows the door to temporarily break away from its vertical guide tracks in the event of a collision between the door and an obstruction.

In some embodiments, a track follower couples a door panel to two vertical tracks that help guide the vertical movement of the door. A releasable mechanical connector between the door and the track follower enables the door panel to breakaway during a collision. And a signal generator (e.g., an oscillator) associated with an antenna-based proximity sensor is carried by the track follower.

In some embodiments, the releasable electrical connector is incorporated into the releasable mechanical connector.

In some embodiments, the releasable mechanical connector is selectively releasable by use of a magnet.

In some embodiments, the releasable electrical connector is between the antenna and a signal generator that applies a signal on the antenna.

In some embodiments, the releasable electrical connector is between the signal generator and a stationary power source.

In some embodiments, an antenna-based proximity sensor is applied to a breakaway door that has a roll-up door panel.

In some embodiments, an antenna-based proximity sensor is applied to a breakaway door that has a series of pivotally interconnected panels.

In some embodiments, a vertically translating door with an antenna-based proximity sensor includes a signal generator installed at a fixed location.

In some embodiments, a roll-up door with an antenna-based proximity sensor includes wiring with a rotatable feature that allows the wiring to wrap around the same drum that supports the roll-up door.

In some embodiments, the rotatable feature of the wiring is a rotatable electrical connector.

In some embodiments, the rotatable feature of the wiring is provided by a wire being able to twist about itself.

In some embodiments, wiring between the antenna and the power source extends through the drum that supports a roll-up door, whereby the wires can accommodate twisting about themselves.

DESCRIPTION OF THE PREFERRED EMBODIMENT

Figure 1:
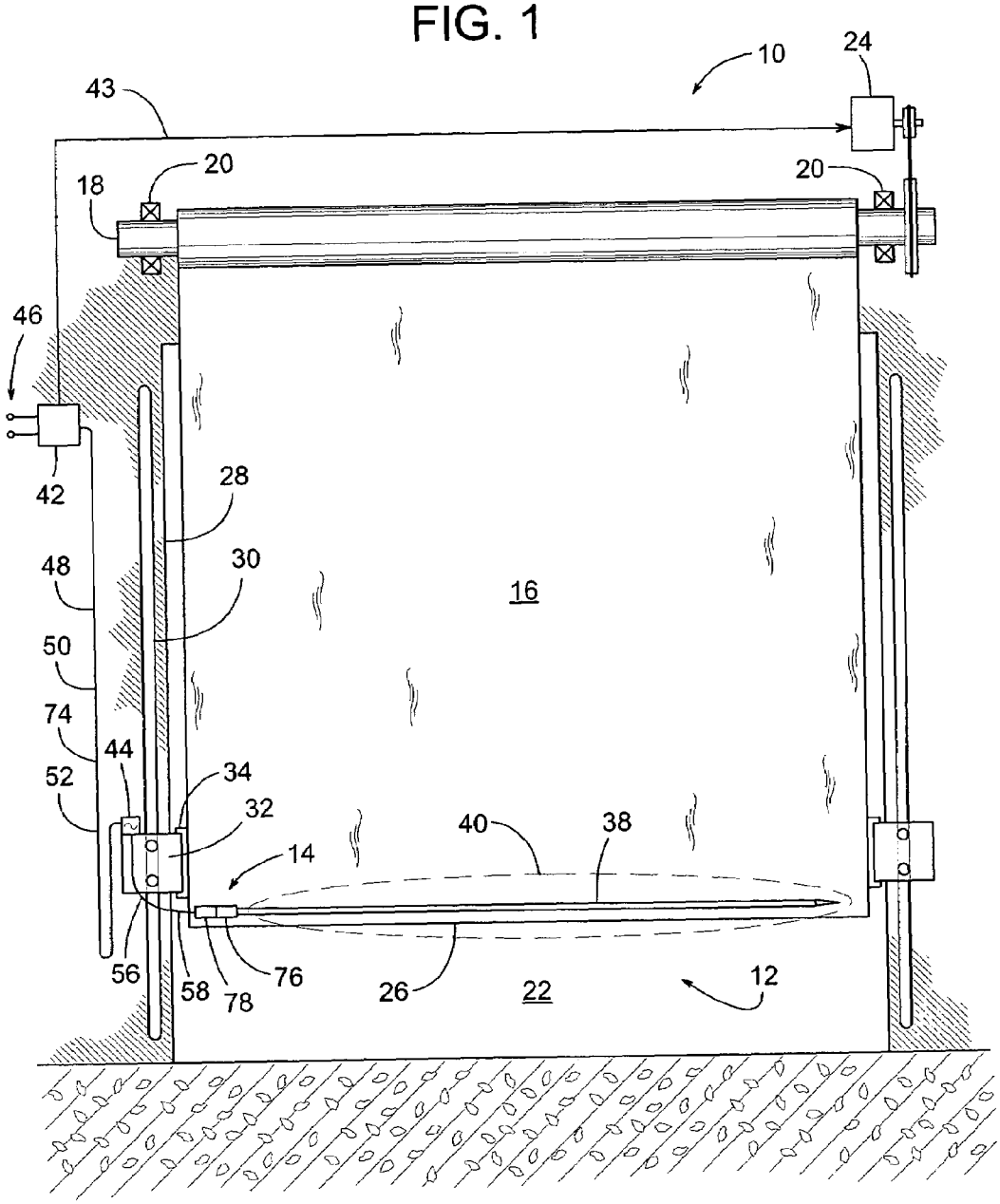
FIG. 1 is a front view of a partially opened translating door panel that includes an antenna-based proximity sensor and a breakaway feature for the panel.
Figure 2:
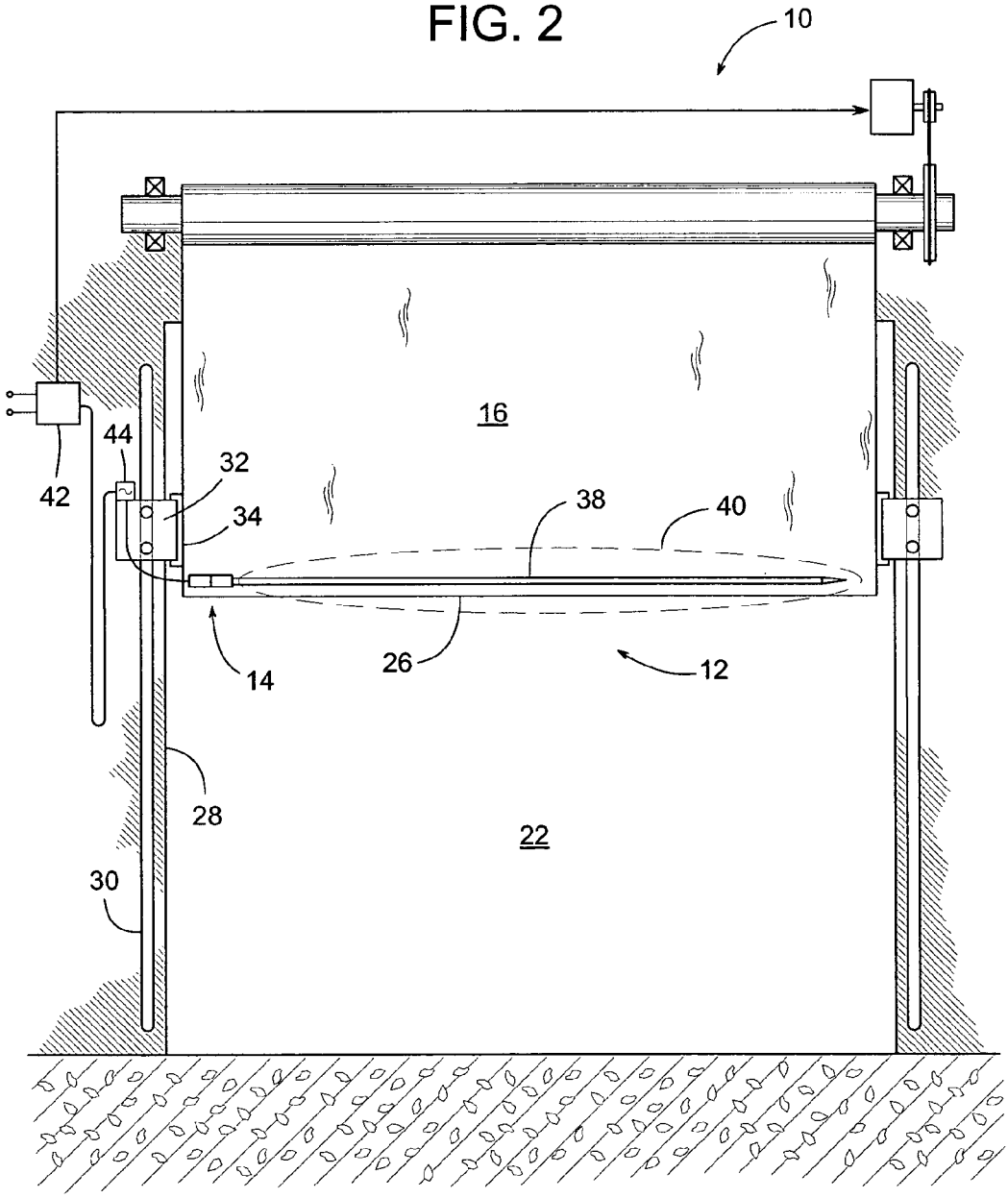
FIG. 2 is a front view of the same door as in FIG. 1 but showing the door panel opened further.
Figure 3:
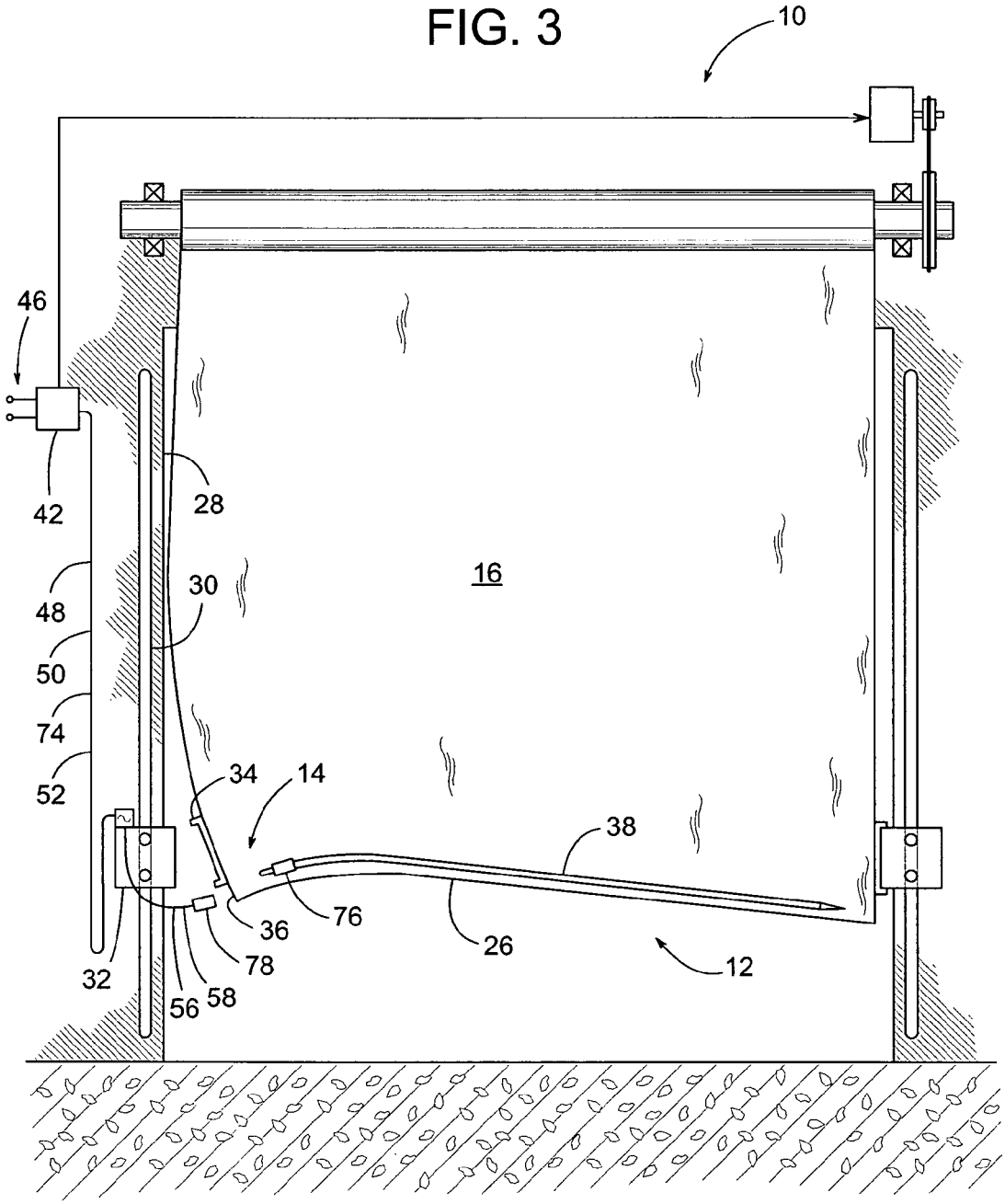
FIG. 3 is a front view of the same door as in FIG. 1 but showing a lower portion of the door panel separated from the doorframe.

A door system 10, shown in FIGS. 1-3, includes an antenna-based proximity sensor 12 having a releasable electrical connector 14 that enables sensor 12 to function with a breakaway feature of the door. FIG. 1 shows door system 10 with its door panel 16 in a nearly closed position, FIG. 2 shows door panel 16 at a more open position, and FIG. 3 shows door panel 16 having been released by the breakaway feature of the door.

In some embodiments, door panel 16 is made of a pliable curtain that wraps about a rotatable drum 18, which in turn is supported by a set of bearings 20. To open and close the door relative to a doorway 22, a drive unit 24 rotates drum 18 in either direction. The drum's direction of rotation determines whether drum 18 takes up or pays out panel 16.

To guide a leading edge 26 of panel 16 along a generally vertical path, door system 10 includes doorframe 28 with a track 30. Track 30 and doorframe 28 may be separate parts, or the two may be a single part with track 30 being an integral feature of doorframe 28. A track follower 32, which is confined to travel along track 30, couples panel 16 to doorframe 28. Doorframe 28, track 30, and track follower 32 are schematically illustrated to represent all types of doorframes, tracks, and track followers. Examples of track 28 include, but are not limited to, a channel, slot, rail, etc. Examples of track follower 32 include, but are not limited to, a trolley, sliding block, linear bearing, etc. A few detailed examples of track follower 32 can be found in U.S. Pat. Nos. 4,887,659; 6,098,695; and 6,352,097 which are specifically incorporated by reference herein.

To avoid impact-related damage to door panel 16, doorframe 28, track 30, or track follower 32, the breakaway feature of door system 10 is provided by a releasable mechanical connector 34 that releasably connects door panel 16 to track follower 32. If door panel 16 is subjected to a predetermined external force, due to panel 16 closing on an obstruction or something striking the door, connector 34 reacts by releasing panel 16 (i.e., releasing at least one end 36 of the door panel's leading edge 26) from track 30 or doorframe 28. After connector 34 releases panel 16, connector 34 and panel 16 can be readily returned to their normal operating conditions. Connector 34 is schematically illustrated to represent any mechanism that enables a door panel to returnably release from its track or doorframe. A few examples of releasable mechanical connector 34 are disclosed in U.S. Pat. Nos. 6,148,897; 6,321,822; 5,957,187; 5,887,385; 5,638,883; 5,620,039; 5,271,448; and 5,025,847 which are specifically incorporated by reference herein. In some embodiments, connector 34 and track follower 32 are held together by a magnetic force of a predetermined magnitude. The door panel's leading edge 26 can be rigid or flexible, and depending on the type of door, the door panel itself can be flexible or rigid.

To help avoid an impact between a closing door panel 16 and a nearby body or object, proximity sensor 12 includes an antenna 38 disposed along leading edge 26 of panel 16. When a nearby body or object disturbs an electromagnetic field 40 around antenna 38, a controller 42 reacts by energizing an alarm and/or affecting the operation of door system 10. In some cases, for instance, an output 43 from controller 42 may cause drive unit 24 to stop or reverse the movement of door panel 16.

Figure 4:
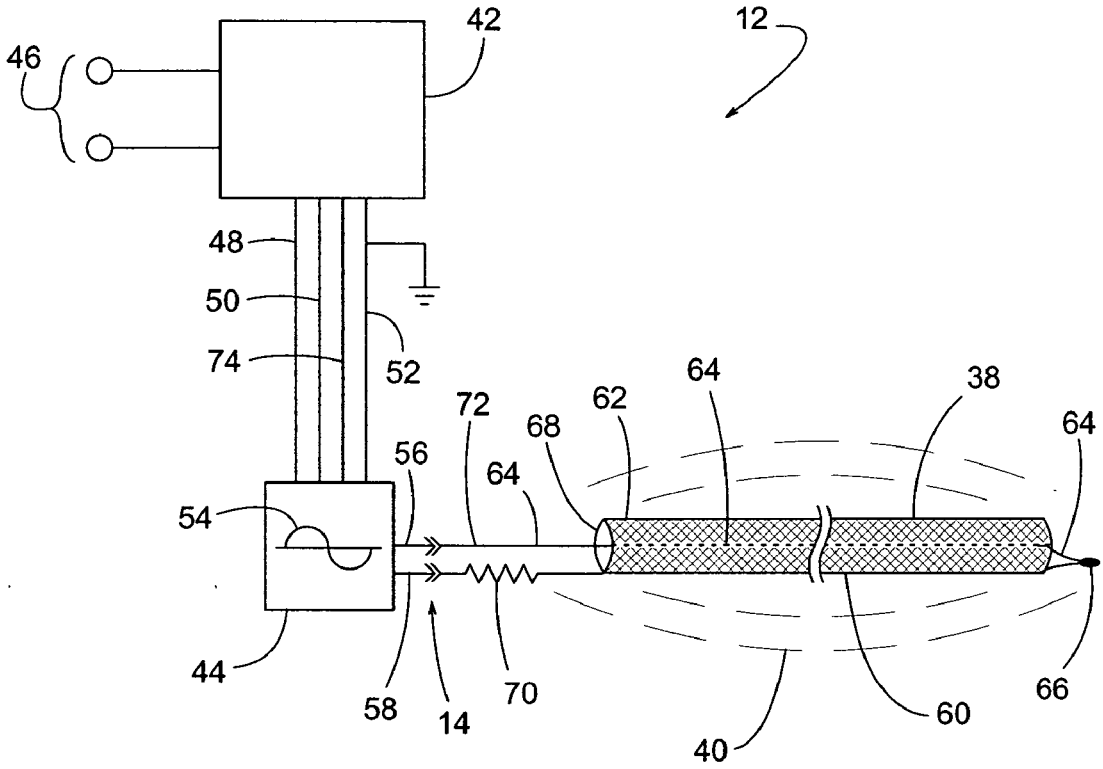
FIG. 4 is a schematic diagram of an antenna-based proximity sensor.

The operation of antenna-based proximity sensor 12 can be understood with reference to FIG. 4 and/or with reference to U.S. Pat. No. 5,337,039, which is specifically incorporated by reference herein. In FIG. 4, antenna-based proximity sensor 12 is shown to comprise controller 42, a signal generator 44 (e.g., an oscillator), and antenna 38. Controller 42, which may be powered by a conventional power source 46 (e.g., 120 VAC), provides electrical power to signal generator 44 via electrical lines 48 and 50. A third line 52 between controller 42 and signal generator 44 provides a ground connection. In a currently preferred embodiment, signal generator 44 functions as a conventional oscillator that provides antenna 38 with a signal 54 that creates the electromagnetic field 40 around antenna 38. Releasable electrical connector 14 and lines 56 and 58 convey signal 54 to antenna 38. The actual voltage, power and frequency of signal 54 may vary; however, in some cases signal 54 is about 9-volts peak-peak at a nominal frequency of about one-megahertz.

Antenna 38 may comprise a coaxial cable 60 whose conductive sheath 62 and central wire 64 are soldered or otherwise connected to each other at an outboard end 66 of antenna 38. An inboard end 68 of sheath 62 is wired to signal generator 44 via a 47 k ohm resistor 70, and line 72 connects an inboard end of wire 64 to signal generator 44.

Under normal conditions where field 40 is generally undisturbed, signal generator 44 oscillates at its nominal frequency (e.g., one-megahertz). The frequency (or change thereof) of this signal is communicated back to controller 42 via line 74. When a body or object disturbs field 40 by altering the capacitive coupling between antenna 38 and ground, signal generator 44 tends to oscillate at some lower frequency below the nominal frequency of one-megahertz. This drop in frequency is what identifies that a nearby obstruction may be present. The actual magnitude of the delta-frequency depends on the type of disturbance and the geometry of the antenna. The drop in frequency is detected by comparing the oscillating frequency of signal generator 44 to a conventional phase lock loop circuit that may be incorporated in signal generator 44 or controller 42.

When door panel 16 breaks away from doorframe 28, damage to the antenna-based proximity sensor 12 can be avoided by installing releasable electrical connector 14 somewhere between power source 46 and antenna 38. Although the actual structure and location of connector 14 may vary, in some cases, connector 14 comprises a conventional plug 76 and socket 78 installed between signal generator 44 and antenna 38. Depending on the particulars of the connection between generator 44 and antenna 38, connector 14 may or may not need to be a coaxial connector. When door panel 16 releases or breaks away from doorframe 28, plug 76 simply pulls apart from socket 78 as shown in FIG. 3. Plug 76 separating from socket 78 interrupts the electrical path between power supply 46 and antenna 38. Afterwards, connectors 14 and 34 can each be returned to their normally attached conditions to re-establish the electrical path between controller 42 and antenna 38 and to restore door system 10 back to normal operation.

Figure 5:
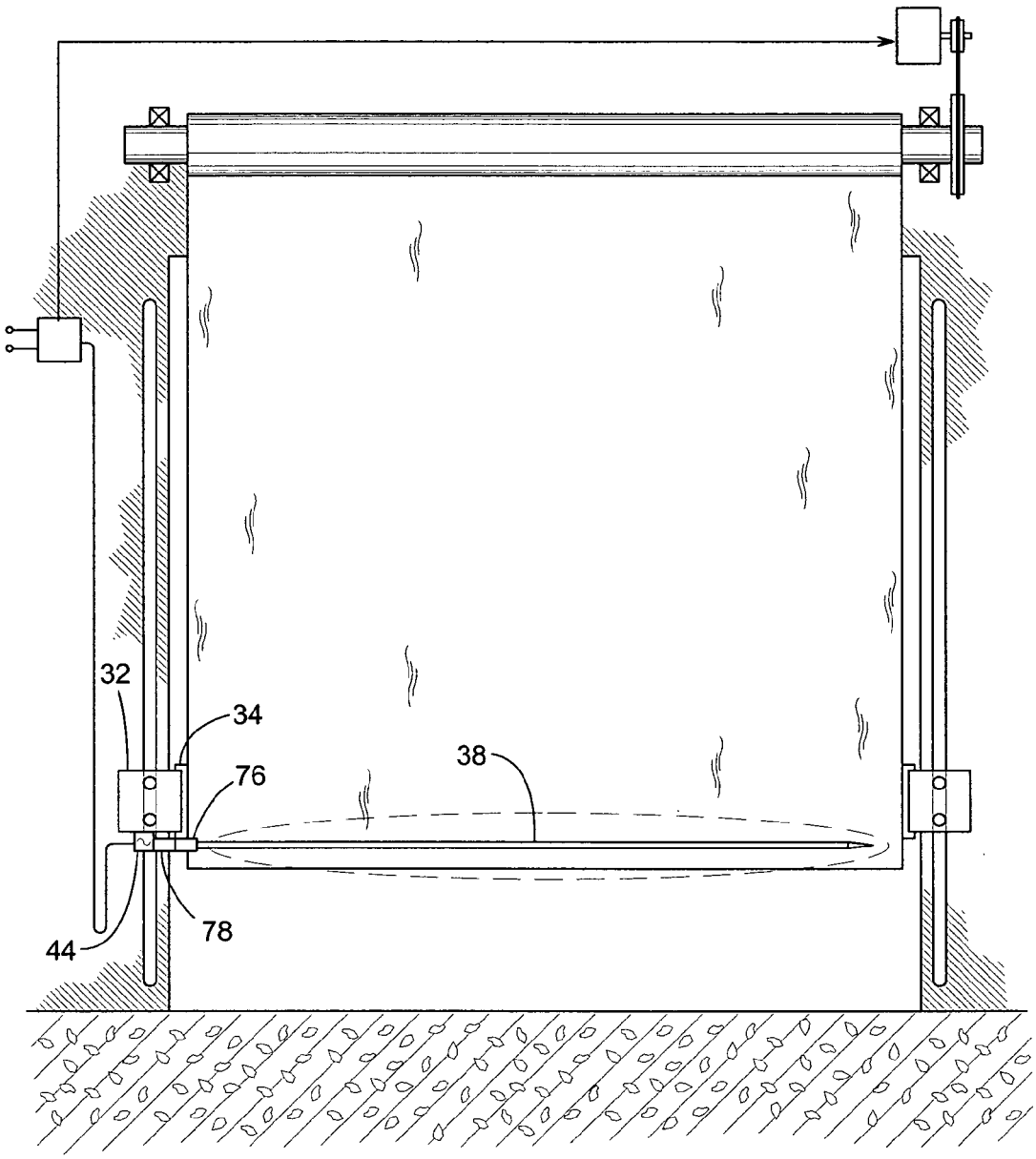
FIG. 5 is a front view similar to FIG. 1 but showing another embodiment of a translating door system.
Figure 6:
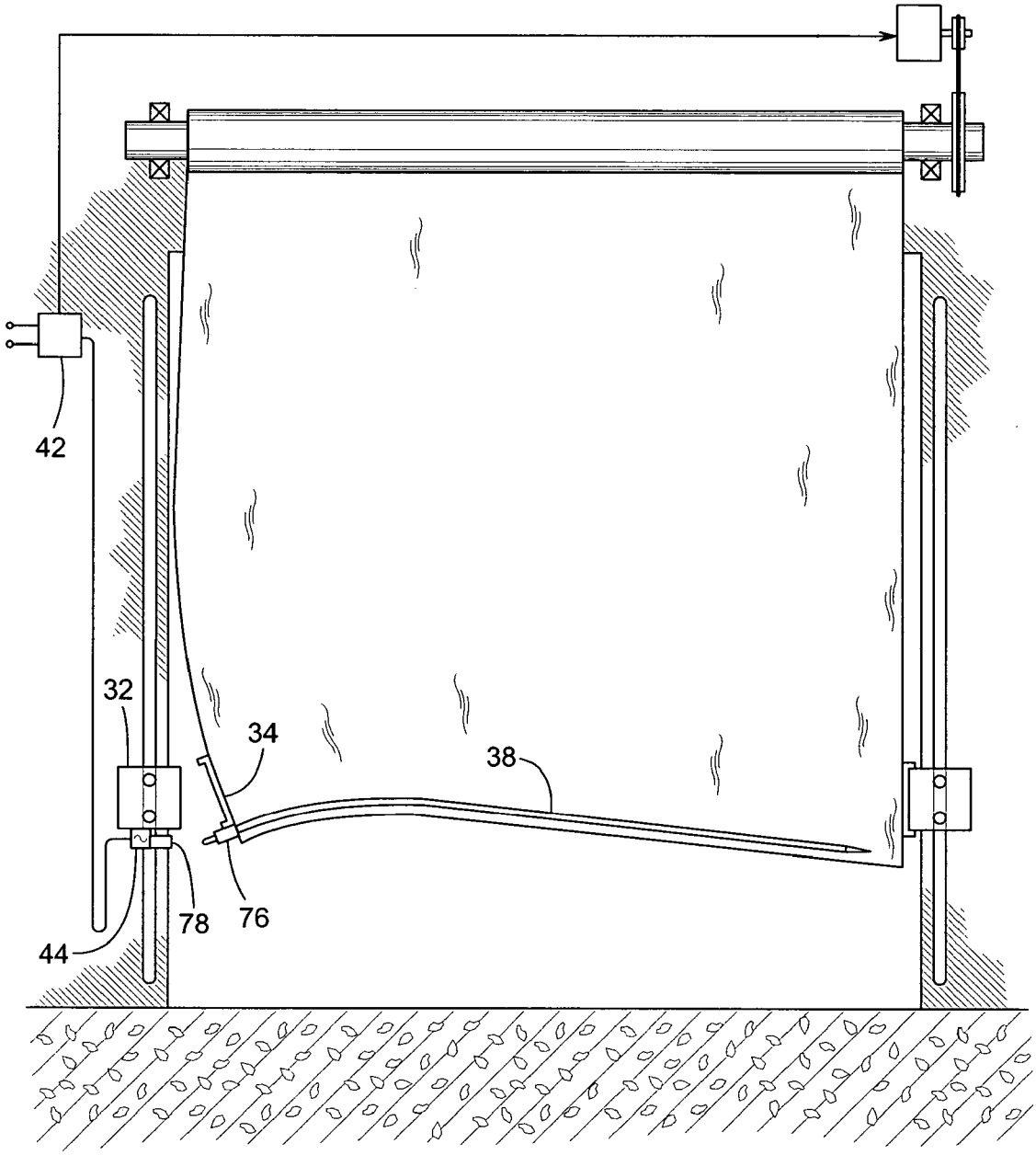
FIG. 6 is a front view of the same door as in FIG. 5 but showing a lower portion of the door panel separated from the doorframe.

To simplify the reattachment of connectors 14 and 34, the structures of the two connectors 14 and 34 can be operatively connected or combined to operate in unison, whereby connectors 14 and 34 break away and reconnect as a unit rather than as separate mechanical and electrical connectors. In FIGS. 5 and 6, for example, socket 78 is fixed relative to track follower 32 and plug 76 is fixed relative to mechanical connector 34. Signal generator 44 can be installed adjacent to socket 78 to minimize or eliminate the wiring between generator 44 and socket 78.

Figure 7:
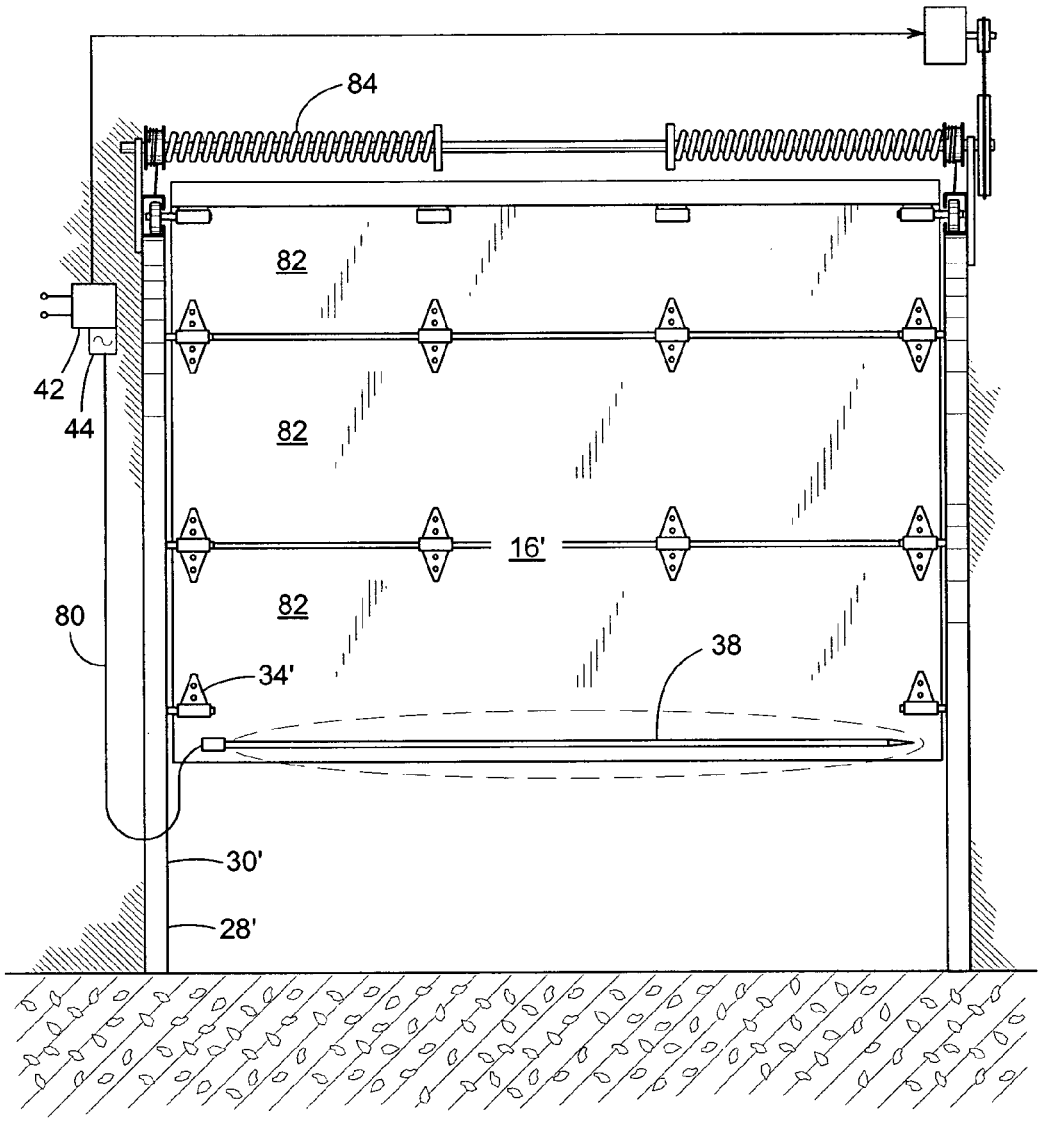
FIG. 7 is a front view similar to FIG. 1 but showing a door system having pivotally interconnected panel members.

Signal generator 44 can also be mounted at a stationary location as shown in FIG. 7. In this case, a long flexible wire 80 (e.g., a coiled electrical cable) connects signal generator 44 to antenna 38. Wire 80 is of sufficient length and flexibility to allow a door panel 16' to break away from a track 30' of a doorframe 28'. Although, in this example, door panel 16' comprises a series of pivotally interconnected rigid or semi-rigid panel members 82, a pliable door panel or curtain is also well within the scope of the invention. When heavier rigid panels are used, a spring 84 or counterweight can be used to help offset the weight of the door panel members. A releasable mechanical connector 34' allows door panel 16' to break away from track 30'.

Figure 8:
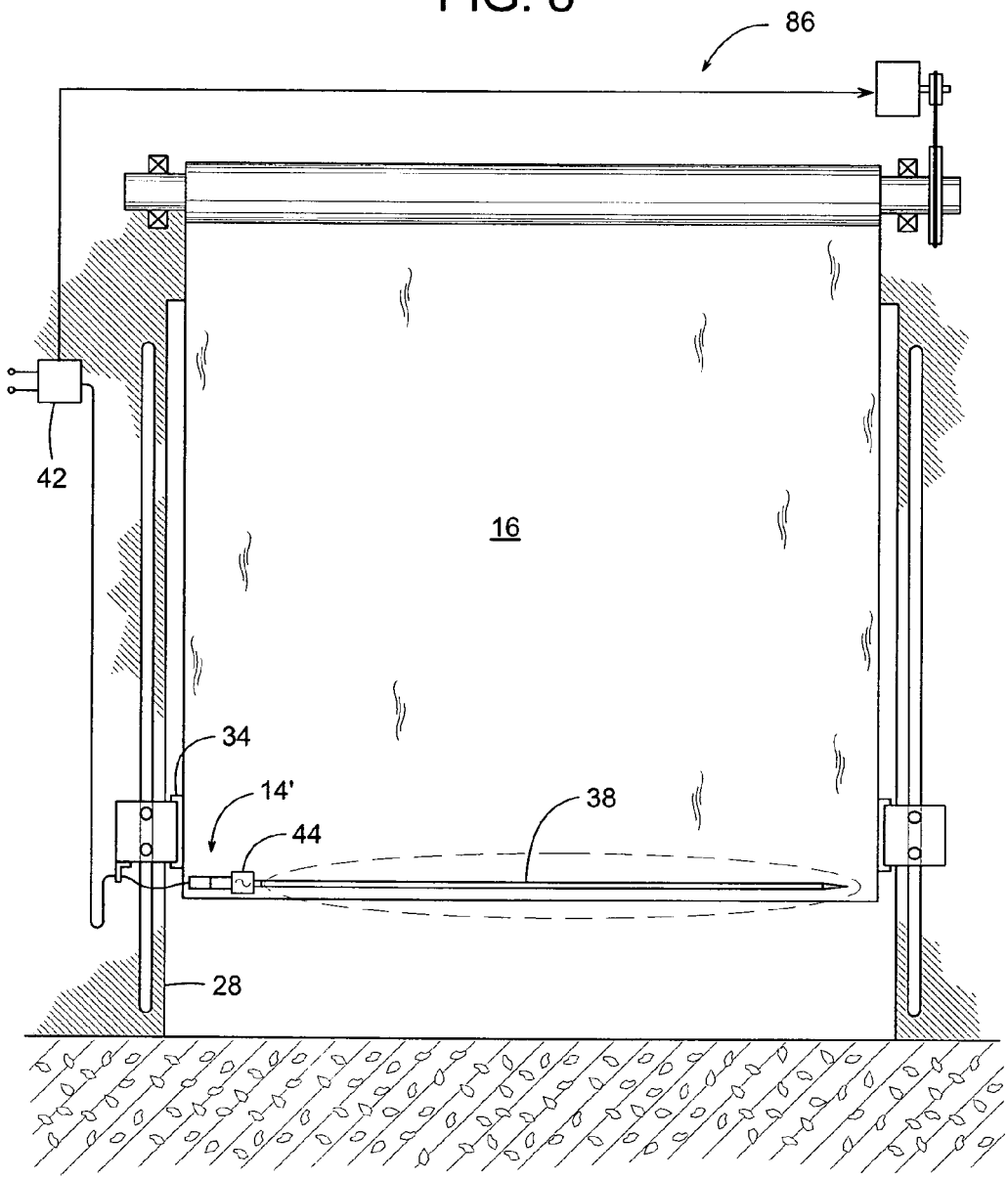
FIG. 8 is a front view similar to FIG. 1 but showing another embodiment of a translating door system.
Figure 9:
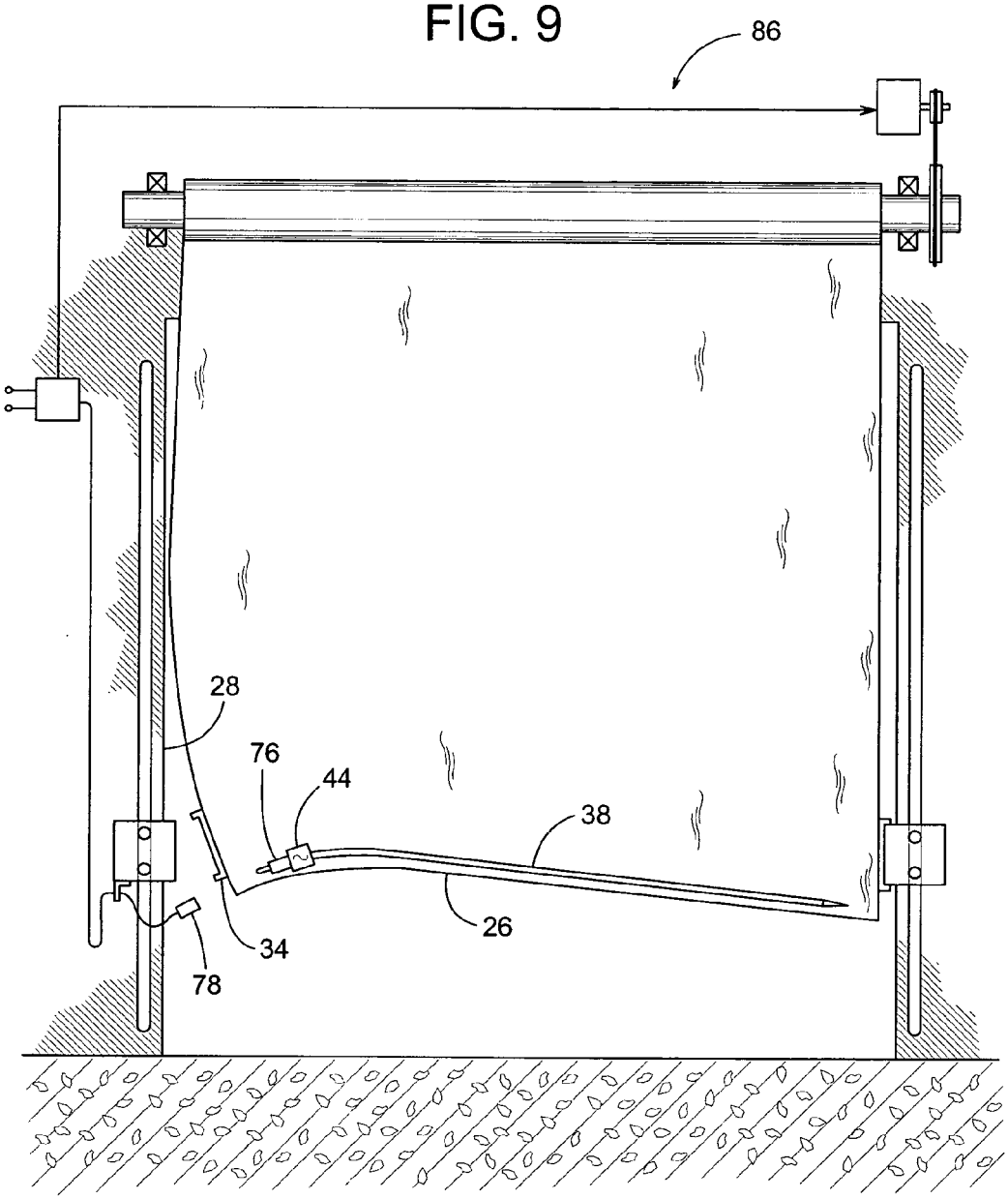
FIG. 9 is a front view of the same door as in FIG. 8 but showing a lower portion of the door panel separated from the doorframe.

In another embodiment, shown in FIGS. 8 and 9, a door system 86 has signal generator 44 attached to door panel 16, and releasable electrical connector 14' is interposed between generator 44 and controller 42. In this case, connector 14' has multiple conductors for carrying both the signal voltage on line 74 and the generator's supply voltage. FIG. 8 shows door system 86 in its normal operating condition, and FIG. 9 shows one end of the door panel's leading edge 26 separated from doorframe 28. The separation and reconnection of connectors 14 and 34 is similar to that of door system 10.

Figure 10:
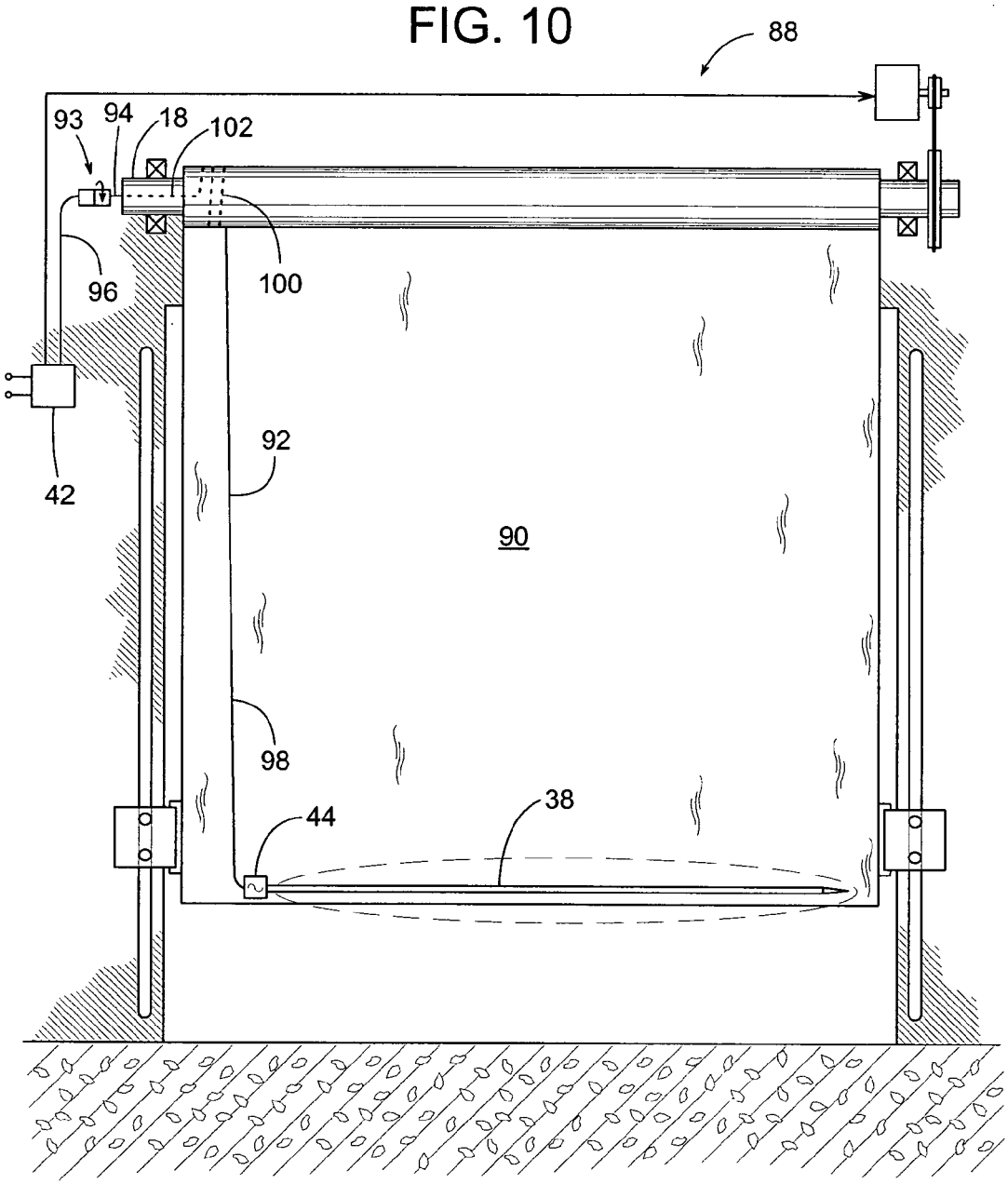
FIG. 10 is a front view similar to FIG. 1 but showing another embodiment of a translating door system.

In FIG. 10, a door system 88 has generator 44 attached to a door panel 90, and a wire 92 with a rotatable feature connects generator 44 to controller 42. In this case, the rotatable feature is a rotatable electrical connector 93 that allows one portion 94 of wire 92 to rotate relative to a stationary portion 96 of wire 92. Such rotatable electrical connectors are well known to those skilled in the art. Portion 98 of wire 92 lies along the face of panel 90 and becomes wrapped about drum 18 as the door opens. Dashed lines 100 show the wrapped portion of wire 92. At some point, portion 100 of wire 98 feeds through a radial hole in drum 18, and a section of wire 102 runs through the interior of drum 18 between connector 93 and the radial hole in drum 18. With this design, a breakaway electrical connector is not needed.

Figure 11:
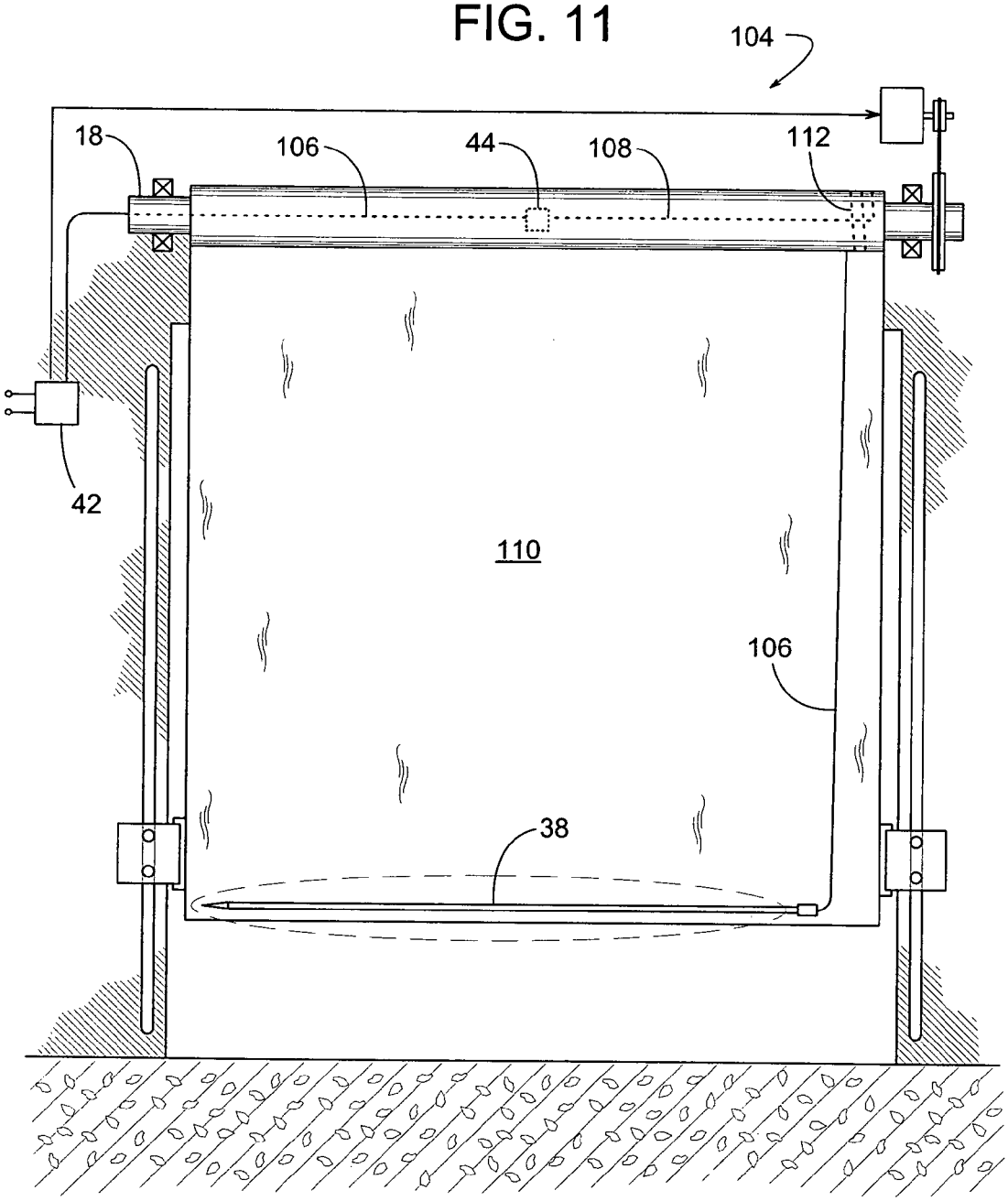
FIG. 11 is a front view similar to FIG. 1 but showing yet another embodiment of a translating door system.

FIG. 11 shows another door system 104 that does not need a breakaway electrical connector. Door system 104 is similar to door system 88; however, the rotatable feature of a wire 106 between controller 42 and antenna 38 is provided by one or more wire sections 106 and/or 108 being able to twist about itself within the hollow interior of drum 18. In this example, wire 106 lies along a face of a door panel 110 with a portion 112 of wire 106 being wrapped about drum 18. Wire 106 extends through a radial hole in drum 18, and wire section 108 extends from that hole to signal generator 44. Wire section 106 connects generator 44 to controller 42. Although generator 44 is shown near the center of drum 18, generator 44 could be at either end of drum 18 or even mounted adjacent to controller 42 or adjacent to antenna 38. Placing generator 44 adjacent to controller 42 could eliminate or minimize the length of wire section 106.

Although the invention is described with respect to a preferred embodiment, modifications thereto will be apparent to those skilled in the art. Therefore, the scope of the invention is to be determined by reference to the claims, which follow.

We claim:

1. A door system associated with a power source, comprising:

a doorframe;

a door panel having a leading edge that is vertically movable in translation along the doorframe, wherein the leading edge has at least one end that can release from the doorframe for an applied force above a certain magnitude;

an antenna disposed adjacent to the leading edge and being vertically movable in translation therewith;

a signal generator electrically coupled to the antenna, whereby the signal generator creates an electromagnetic field adjacent to the antenna; and a releasable electrical connector selectively providing and interrupting an electrical path between the antenna and the power source, wherein the releasable electrical connector interrupts the electrical path in reaction to the one end of the leading edge releasing from the doorframe.

2. The door system of claim 1, further comprising:

a track follower movably attached to the doorframe for vertical movement in translation along the doorframe; and a releasable mechanical connector that releasably couples the leading edge of the door panel to the track follower, wherein the signal generator is carried by the track follower.

3. The door system of claim 2, wherein the releasable electrical connector is operatively connected to the releasable mechanical connector, whereby the releasable electrical connector interrupts the electrical path in response to the releasable mechanical connector releasing the one end of the leading edge from the track follower.

4. The door system of claim 2, wherein the releasable mechanical connector operates by virtue of magnetic attraction.

5. The door system of claim 1, wherein the signal generator is carried by the door panel.

6. The door system of claim 1, wherein the releasable electrical connector is interposed between the antenna and the signal generator.

7. The door system of claim 1, wherein the releasable electrical connector is interposed between the signal generator and the power source.

8. The door system of claim 1, wherein the door panel is a pliable curtain.

9. The door system of claim 1, wherein the door panel comprises a series of pivotally interconnected panel members.

10. A door system associated with a power source, comprising:

a doorframe;

a door panel having a leading edge that is vertically movable in translation along the doorframe, wherein the leading edge has one end that can release from the doorframe for an applied force above a certain magnitude;

an antenna disposed adjacent to the leading edge and being vertically movable in translation therewith;

a signal generator at a substantially fixed location; and a flexible electrical connector that connects the signal generator to the antenna, whereby the signal generator creates an electromagnetic field adjacent to the antenna and the flexible electrical connector accommodates movement of the antenna relative to the substantially fixed location of the signal generator.

11. The door system of claim 10, further comprising:

a track follower movably attached to the doorframe for vertical movement in translation along the doorframe; and a releasable mechanical connector that releasably couples the leading edge of the door panel to the track follower, wherein the flexible electrical connector accommodates movement of the leading edge relative to the track follower.

12. The door system of claim 10, wherein the door panel is a pliable curtain.

13. The door system of claim 10, wherein the door panel comprises a series of pivotally interconnected panel members.

14. A door system associated with a power source, comprising:

a doorframe;

a door panel having a leading edge that is vertically movable in translation along the doorframe, wherein the leading edge has one end that can release from the doorframe for an applied force above a certain magnitude;

an antenna disposed adjacent to the leading edge and being movable therewith;

a signal generator electrically coupled to the antenna, whereby the signal generator creates an electromagnetic field adjacent to the antenna; and a wire providing an electrical path between the antenna and the power source and having a rotatable feature that accommodates movement of the antenna.

15. The door system of claim 14, further comprising a rotatable drum, wherein the door panel wraps about the drum as the door panel moves to an open position, and the rotatable feature is the wire being able to wrap around the drum as the door panel moves to the open position.

16. The door system of claim 15, wherein the rotatable drum is hollow with the wire extending therethrough, and the rotatable feature further includes the wire being able to twist about itself within the rotatable drum as the door panel moves to the open position.

17. The door system of claim 14, wherein the wire includes a rotatable electrical connector that provides the rotatable feature of the wire.

18. The door system of claim 17, wherein the rotatable electrical connector is interposed between the antenna and the signal generator.

19. The door system of claim 17, wherein the rotatable electrical connector is interposed between the signal generator and the power source.

20. The door system of claim 14, wherein the signal generator is attached to the door panel.

21. The door system of claim 14, wherein the signal generator is at a substantially fixed location.

* * * * *